US011375746B2

(12) United States Patent
Kido et al.

(10) Patent No.: US 11,375,746 B2
(45) Date of Patent: Jul. 5, 2022

(54) SMOKING ARTICLE WITH LIQUID-FILLED DIRECTIONAL CAPSULE

(71) Applicant: JT International S.A., Geneva (CH)

(72) Inventors: Yuichiro Kido, Tokyo (JP); Noritoshi Fujita, Kanagawa (JP); Hiroyoshi Ono, Tokyo (JP)

(73) Assignee: JT International S.A.

( * ) Notice: Subject to any disclaimer, the term of this patent is extended or adjusted under 35 U.S.C. 154(b) by 342 days.

(21) Appl. No.: 16/345,337

(22) PCT Filed: Oct. 30, 2017

(86) PCT No.: PCT/EP2017/077819
§ 371 (c)(1),
(2) Date: Apr. 26, 2019

(87) PCT Pub. No.: WO2018/078169
PCT Pub. Date: May 3, 2018

(65) Prior Publication Data

US 2019/0246690 A1 Aug. 15, 2019

(30) Foreign Application Priority Data

Oct. 31, 2016 (EP) ..... 16196644

(51) Int. Cl.
*A24D 3/04* (2006.01)
*A24D 3/06* (2006.01)
*A24D 1/02* (2006.01)

(52) U.S. Cl.
CPC ..... *A24D 3/061* (2013.01); *A24D 1/02* (2013.01); *A24D 1/027* (2013.01); *A24D 3/04* (2013.01); *A24D 3/043* (2013.01); *A24D 3/048* (2013.01); *A24D 3/06* (2013.01)

(58) Field of Classification Search
None
See application file for complete search history.

(56) References Cited

U.S. PATENT DOCUMENTS

2013/0047999 A1* 2/2013 Rushforth ..... A24D 3/061
131/332

FOREIGN PATENT DOCUMENTS

EP 2923588 A1 * 9/2015 ..... A24D 3/04
EP 2923588 A1 9/2015
WO 2012156694 A1 11/2012
(Continued)

OTHER PUBLICATIONS

Machine Translation of WO 2014/156839 A, Fujita and Hiroki et al., Japan Tobacco, Oct. 2, 2014, 11 pages. (Year: 2014).*
(Continued)

*Primary Examiner* — Linda L Gray
(74) *Attorney, Agent, or Firm* — Lerner, David, Littenberg, Krumholz & Mentlik, LLP

(57) ABSTRACT

A smoking article includes a rod element of smokeable material connected to a filter element by a tipping wrapper. The filter element includes a liquid-filled directional capsule having a predefined rupture region at which the directional capsule is designed to break upon application of external force to release liquid contained therein. An indicator is provided at the tipping wrapper, or else is identifiable through the tipping wrapper, for encouraging a consumer to apply a crushing force in a particular location that can improve the user experience.

9 Claims, 3 Drawing Sheets

(56) References Cited

FOREIGN PATENT DOCUMENTS

| | | | | | |
|---|---|---|---|---|---|
| WO | 2012156698 | A1 | | 11/2012 | |
| WO | WO-2012156694 | A1 | * | 11/2012 | ..... A24D 3/048 |
| WO | WO-2012156698 | A1 | * | 11/2012 | ..... A24D 3/048 |
| WO | WO-2014156839 | A1 | * | 10/2014 | ..... A24D 3/04 |
| WO | 2016050688 | A1 | | 4/2016 | |
| WO | WO-2016060688 | A1 | * | 4/2016 | ..... G01V 11/00 |
| WO | WO-2016092295 | A1 | * | 6/2016 | ..... A24C 5/474 |

OTHER PUBLICATIONS

International Search Report including Written Opinion for PCT/EP2017/077819 dated Jan. 16, 2018.
Extended European Search Report including Written Opinion for EP16196644.5 dated Apr. 11, 2017.

* cited by examiner

SMOKING ARTICLE WITH LIQUID-FILLED DIRECTIONAL CAPSULE

CROSS-REFERENCE TO RELATED APPLICATIONS

The present application is a national phase entry under 35 U.S.C. § 371 of International Application No. PCT/EP2017/077819, filed Oct. 30, 2017, published in English, which claims priority to European Application No. 16196644.5, filed Oct. 31, 2016, the disclosures of which are incorporated herein by reference.

BACKGROUND OF THE INVENTION

The present invention relates to a smoking article which includes a filter element having a liquid-filled directional capsule.

Smoking articles, such as cigarettes, cigarillos or the like, are popular consumer products that typically have a generally cylindrical rod shaped configuration and include a charge, roll, or column of smokeable material, such as shredded tobacco (e.g. in cut filler form), which is surrounded by a paper wrapper forming a so-called "tobacco rod". A cigarette or cigarillo usually also has a cylindrical filter element aligned in end-to-end relationship with the tobacco rod. The filter element may, for example, comprise a plug of cellulose acetate tow, and the tow is circumscribed by a wrapper material known as "plug wrap". Typically, the filter element is attached to one end of the tobacco rod using a circumscribing wrapping material known as "tipping wrapper". The filter element wrapped by the tipping wrapper is known as "mouthpiece element".

In recent years there has been increasing consumer demand for smoking articles providing modified sensory attributes, and particularly for cigarettes incorporating filter elements, which may act as vehicles for adding flavour to mainstream smoke of the cigarettes. Specifically, these smoking articles have included flavour-altering substances in breakable pellets or capsules. During cigarette manufacture, the filter material is formed into a continuous filter rod having such pellets or capsules positioned within that rod; e.g., along a longitudinal axis thereof. The continuous filter rod is then divided or cut at predetermined intervals to form a plurality of filter elements, such that each filter element includes at least one of the capsules. The capsules are then manually broken by the consumer to release a substance into the filter material which acts to alter one or more characteristics of the mainstream smoke during smoking, such as flavour, taste, or TNCO levels (tar, nicotine, CO).

Generally, the consumer cannot see the breakable capsule inside of the mouthpiece element, as it may be embedded in filtration material and/or wrapped by one or more wrappers. To assist the consumer to find the capsule, two main options have been proposed; provide a transparent section or window over a portion of the capsule so that it is at least partly visible, and provide printed indicia on the tipping wrapper over the capsule. In other words, these solutions teach the consumer where the capsule is positioned.

Most breakable capsules available in the market are generally spherical and have a substantially isotropic resistance to break. Therefore, providing indicators that help the consumer to locate the capsule is normally enough to teach the consumer where to apply force to break the capsule.

Recently, other types of breakable capsules have been proposed, which do not have an isotropic resistance to break. An example of such a capsule is disclosed in WO 2016/050688. In these capsules it has been found that it is not sufficient merely to teach the consumer where the capsule is located. It has been found that this will not typically enable the consumer to break the capsule easily and effectively release its contents. Technical constraints such as these have delayed introduction of commercial products including these kinds of breakable capsules.

BRIEF SUMMARY OF THE INVENTION

It is therefore an object of the invention to provide a smoking article with a liquid-filled capsule that teaches a consumer where to apply a required force to break the capsule and effectively release its contents.

According to an aspect of the invention there is provided a smoking article, comprising: a rod element of smokeable material connected to a filter element by a tipping wrapper, the filter element having a first end for connection to the rod element and an opposite, second end for insertion into a mouth of a user, the filter element comprising: a liquid-filled directional capsule arranged between the first and second ends of the filter element, the directional capsule having a predefined rupture region at which the directional capsule is designed to break upon application of external force to release liquid contained therein, wherein the directional capsule comprises a predefined crushing region; and an indicator provided at the tipping wrapper, or identifiable through the tipping wrapper, for indicating a predefined force application region, the predefined force application region overlying the predefined crushing region.

In this way, the indicator can teach a consumer where to apply force to release capsule contents in an efficient manner. Careful positioning of the indicator can ensure that the consumer can break the directional capsule easily and release sufficient liquid contents to produce a noticeable effect on the characteristics of mainstream smoke in a single action.

The indicator is provided at the tipping wrapper. As used herein 'at the tipping wrapper' may be understood to mean that the indicator is provided in, on or with the tipping wrapper. The indicator may be provided on one surface of the tipping wrapper or it may be embedded within the tipping wrapper.

It will be noted that the term "liquid-filled directional capsule" as used herein refers to a capsule containing a volume of liquid that is adapted to direct liquid release into a particular desired direction or towards a particular desired region. In particular, the rupture region of the capsule may be arranged to release the liquid in an axial direction, such as a longitudinal axis of the filter element, into an adjacent region of filter material, especially a fibrous filter material like cellulose acetate tow.

Typically, a significant number of consumers crush the capsule with their teeth; they introduce the filter element into their mouth and apply the required force to crush the capsule with their teeth. To do so, the consumer first feels with the teeth where the capsule is positioned, and, once identified, then bites the filter at the capsule's hinted location to release its contents. This blind operation is doomed to fail with directional capsules having a rupture region, as, as explained above, locating the capsule is not sufficient to release efficiently its contents. Accordingly, if the consumer breaks the capsule with the teeth, contents release will not be guaranteed to an extent required to impart a noticeable effect on the mainstream smoke.

The inventors have found that the main reason for breaking the capsule with the teeth instead of with the fingers is the pain felt on the finger, and have also found that the location of the predefined crush region along a length (L) the directional capsule extends impacts on the pain felt on the finger when applying the crushing force. This results in a larger number of consumers effectively and efficiently crushing the directional capsule, as the provided indicator is visible while crushing.

To limit the pain felt on the finger, the liquid-filled directional capsule extends a length (L) along the filter element, and the predefined crush region is located between the rupture region of the directional capsule and 60% of the length (L) of the directional capsule. By locating the predefined crush position within the above range, the discomfort experienced by the consumer when applying the crushing force is limited and, therefore, a larger number of consumers will opt to crush the directional capsule with their fingers, resulting in effective and efficient crushing, as the provided indicator is visible while crushing.

It will be noted that the phrase "the directional capsule extends a length along the filter element" as used herein refers to the fact that the directional capsule is contained between two parallel planes, transversal to the filter element, which are spaced a distance, which corresponds to the length of the directional capsule. Therefore, the length of the directional capsule is measured in a direction perpendicular to the planes from the plane closest to the rupture region of the directional capsule. In other words, the directional capsule extends a length between first and second parallel planes that are transversal to the filter, the rupture region is located closer to the first plane than to the second plane, and the length of the directional capsule is measured from the first plane to the second plane in a direction perpendicular to both planes. In other words, the parallel planes define ends of the directional capsule. The rupture region is generally, but not necessarily, positioned proximate the first plane. In this case, the directional capsule end at the first plane is referred to as rupture end, and the directional capsule end at the second plane is referred to as base end.

The directional capsule may be arranged in the filter element such that the rupture region is located closer to the first end of the filter element than to the second end of the filter element. As an alternative, the directional capsule may be arranged in the filter element with the rupture region located closer to the second end of the filter element than to the first end of the filter element.

In one arrangement the predefined crush region may be located between the rupture point of the directional capsule and 35% of the length of the directional capsule. This has been found particularly effective for minimising any discomfort experienced by the consumer in applying a crushing force.

In another arrangement the predefined crush region may be located between 15% of the length of the directional capsule and 60% of the length of the directional capsule. This has been found effective for releasing a significant proportion of the liquid in a single crushing action, for example at least 70% of the volume of liquid contained in the directional capsule.

In yet another arrangement the predefined crush region may be located between 15% of the length (L) of the directional capsule and 35% of the length (L) of the directional capsule. By guiding the consumer to provide a crushing force in this position, using the indicator, the capsule can be crushed painlessly and a significant proportion of the liquid can also be released, preferably at least 70% of the volume of liquid contained in the directional capsule.

The indicator may include a directional element, such as an arrow or a pointer, for indicating the predefined force application region (which overlies the predefined crush region). A tip or end of the directional element may overlie the predefined force application region, or may end adjacent to the predefined force application region. By providing a directional element arranged to indicate a liquid release direction, the liquid release direction may be self-understood by the consumer. This is especially helpful when two types of smoking articles are grouped into a collation of smoking articles and packed in a packaging for smoking articles, a first smoking article having a directional capsule arranged to release liquid towards the first end of the filter element (i.e., towards the tobacco end of the filter element), and a second smoking article having a directional capsule arranged to release liquid towards the second end of the filter element (i.e., towards the mouth end of the filter element), as it aids the consumer to readily identify which type of liquid release experiment.

The indicator may have a centre of gravity, or a centroid, that overlies the predefined crush region of the directional capsule. The indicator may be provided effectively with a number of different sizes and shapes. By allowing a central position of the indicator to coincide with the predefined force application region, the consumer may be encouraged to provide a crushing force in the optimal location. The indicator may include a circular element, and the centre of the circular element may coincide with the predefined crush region. The indicator may include a line or band that overlies the predefined crush region of the directional capsule and surrounds the filter element about the predefined crush region.

The indicator may be printed on the tipping wrapper. The indicator may be printed using any of a number of media and/or techniques including inks, varnishes, lacquers, embossing, debossing, and hot foil stamping. In another arrangement the indicator may comprise an arrangement of holes or perforations in the tipping wrapper. In yet another arrangement, the indicator may be connected to the tipping wrapper, preferably using glue or some other adhesive.

The indicator may be provided by a translucent region in the tipping wrapper. The translucent region may help the consumer locate the directional capsule and, in certain embodiments, teach the consumer where to provide a crushing force.

The indicator may be provided by a flavoured region in the tipping wrapper. The flavoured region may help the consumer how to locate the directional capsule and, in certain embodiments, teach the consumer where to provide a crushing force.

The indicator may also comprise a marking on the directional capsule which is identifiable through the tipping wrapper. The marking may be provided using any of a number of media or techniques including inks, varnishes, lacquers, embossing, debossing, and hot foil stamping. The marking may be provided as a raised area on the directional capsule. The marking may be identifiable through the tipping wrapper by being viewable through a translucent or transparent area in the tipping wrapper.

In embodiments where the filter element comprises a filter wrapper, the indicator may be provided in the filter wrapper. In this case, the indicator may be identifiable through the tipping wrapper by being viewable through a translucent or transparent area in the tipping wrapper, for example by being viewable through a hole or window in the tipping wrapper. The indicator on the filter wrapper may also be identifiable through the tipping wrapper by being palpable through the tipping wrapper (i.e. identifiable by touch). For example, the indicator may be embossed on the filter wrapper and the embossing may be palpable through the tipping wrapper, for example, through a hole or window in the tipping wrapper.

Summarising, the indicator may provide a sensory contrast with a region around it. In some arrangements, the sensory contrast may be optical, for example by providing a translucent region, or by providing a colour ink that is distinct to the colour of the tipping wrapper on which it is printed. In other arrangements, the indicator may provide a tactile contrast, such as, for example, by providing an embossed pattern that creates a tactile impression different from the tactile impression provided by the region around the indicator. The tactile contrast may also be provided by altering the surface tension, or surface roughness, of the indicator, for example, by providing a smooth feel at the indicator. In yet further arrangements, the indicator may provide a taste contrast, such as, for example, by providing a flavoured region that creates a taste different from the taste provided by the region around the indicator. By providing a tactile and/or a taste contrast, consumers used to breaking capsules with their teeth may continue doing so with directional capsules as they will not need to see the indicator, for they can feel it inside their mouth. The indicator may of course simultaneously provide two or more contrasts, such as optical and tactile contrast by, for example, printing the indicator with a colour varnish that provides a smooth feel.

The indicator may be user activated. For example, the indicator may be perceived only after the user touches it, or licks it. In one arrangement, the indicator comprises a chromic material, which is a material that exhibits chromism. When a chromic material is exposed to an external stimulus, such as light, heat, solvent polarity, pH change, mechanical friction, or mechanical pressure, it undergoes a process that induces a colour change.

The directional capsule may contain a liquid volume of at least 0.05 ml, possibly of at least 0.07 ml. Thus, the directional capsule can hold a significantly larger volume of liquid than that of previously known capsules. It is particularly important to provide a crushing force in an appropriate position with these directional capsules so that the liquid can be dispensed in a single crushing action. Preferably, at least 50% of the volume of liquid contained within the directional capsule is released in a single crushing action.

According to another aspect of the present invention there is provided a liquid-filled directional capsule for use in a smoking article, the liquid-filled directional capsule comprising: a reservoir containing liquid; a predefined rupture region designed to break upon application of external force to release liquid contained in the reservoir; a predefined crushing region; and an indicator provided at an outer surface for indicating the predefined crushing region, wherein, when installed in a smoking article, the indicator is identifiable through the smoking article mouthpiece element.

According to yet another aspect of the invention there is provided a liquid-filled directional capsule for use in smoking articles, comprising a shell defining a cavity that contains a volume of liquid, and comprising a predefined crush region, the shell adapted to break at a predefined rupture region upon application of an external force at the crush region so as to release at least 50% of the volume of liquid contained within the cavity.

The liquid-filled directional capsule defined above may include any of the features described with reference to the smoking article.

BRIEF DESCRIPTION OF THE DRAWINGS

Preferred embodiments of the present invention will now be described, purely by way of example, with reference to the drawings in which.

DETAILED DESCRIPTION

Figure 1:
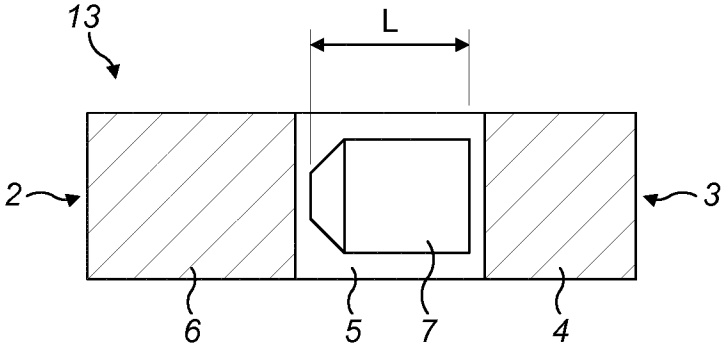
FIG. 1 is a side cross-sectional view of a filter for use in a smoking article in an embodiment of the present invention.
Figure 2:
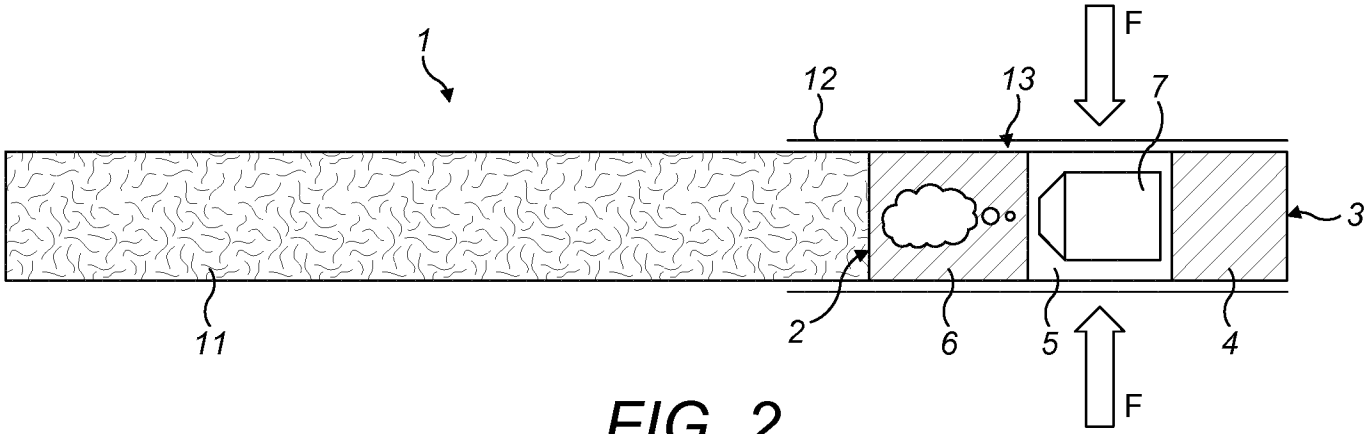
FIG. 2 is a side cross-sectional view of a smoking article in an embodiment of the present invention.

With reference to FIGS. 1 and 2, a smoking article 1 comprises a tobacco rod 11 to which is attached a filter element 13 formed of multiple segments by way of a tipping wrapper 12. The filter element 13 comprises a first end 2 for connection to the tobacco rod 11, typically known as the tobacco end of the filter, and an opposite, second end 3 for insertion into a mouth of a user, typically known as the mouth end of the filter. The filter element 13 comprises an upstream filter segment 6 placed next to the tobacco rod 11 and a downstream filter segment 4 placed at the mouth end. A liquid-filled directional capsule 7 is provided in an intermediate segment 5, located between the upstream filter segment 6 and the downstream filter segment 4. The liquid-filled directional capsule 7 is a capsule that is filled with liquid and is configured to release the liquid content into a predefined region and/or in a predefined direction. In this embodiment the liquid-filled directional capsule 7 includes a rupture region oriented towards the tobacco end 2 of the filter element 13 at which the directional capsule 7 is designed to break upon application of external force to release liquid contained therein. More specifically, the liquid-filled directional capsule 7 is configured to break upon application of a crushing force by a consumer in a direction that is perpendicular to the main axis of the smoking article 1. Typically a consumer will squeeze the directional capsule 7 between two fingers. The force F generated by the consumer causes an elastic deformation of the directional capsule 7, and the internal pressure in the directional capsule 7 increases to a point at which it ruptures. Upon rupture, the liquid contents are expelled into the upstream filter segment 6. In this embodiment the directional capsule 7 contains a liquid volume of at least 0.05 ml, preferably of at least 0.07 ml.

The directional capsule 7 is incorporated in the filter element 13. In one arrangement the directional capsule 7 is placed in the intermediate filter segment 5, which is a cavity formed between the upstream filter segment 6 and the downstream filter segment 4. In other embodiments of the smoking article, the directional capsule 7 may not be placed in a cavity but could be placed directly within the filter tow.

The directional capsule 7 comprises a shell that defines or surrounds a volume of liquid. The shell includes a weakened region or rupture region in which the shell is configured to break preferentially upon application of an external force F. There may be one or more lines of weakness in the rupture region. Alternatively, the rupture region may comprise one or more stress concentrator elements. A combination of lines of weakness and stress concentrator elements would also be possible to form the rupture region.

The directional capsule 7 may be elongate. Alternatively, the directional capsule 7 may be substantially spherical, or ovoidal. The directional capsule 7 may be a seamless shell. Alternatively, the directional capsule 7 may be an open-ended shell, which is closed and sealed with a cap. The shell may have a side wall or lateral wall that extends from an end wall to an open end and thus surrounds or defines a cavity in the shell. The lateral wall may end in a rim at the open end to facilitate application of the cap. The lateral wall may be generally cylindrical or may be faceted. The side or lateral wall may taper or narrow from the open end towards the end wall.

The shell may be made from a resiliently deformable material, such as a polymer material. The cap is typically formed and cut from a section or an expanse of sheet material, such as a laminated plastic sheet material. The liquid in the capsule may comprise purified water or a water-based liquid which contains a dissolved or suspended substance, such as a flavouring substance.

The directional capsule may contain a volume of at least 0.05 ml, for example of at least 0.07 ml, or of at least 0.08 ml. By providing such volume of liquid, the quantity of liquid released with one compression is sufficient to produce a noticeable effect on the characteristics of the mainstream smoke. The volume of liquid in the directional capsule may be no more than 0.15 ml, for example no more than 0.12 ml, or no more than 0.10 ml. By providing such volume of liquid, excessive soaking of the upstream filter segment 6, which can lead to liquid leakage, is prevented.

The filter element 13 typically has a length in the range of about 5 mm to 40 mm, preferably in the range of about 15 mm to about 30 mm. Although the filter element 13 is depicted with multiple segments 4, 5, 6, in an alternative arrangement there may be a single filter segment. The one or more filter segments may comprise any suitable known filter materials including, but not limited to, cellulose acetate, paper and combinations thereof. Thus, the filter element may have at least one segment comprised of a fibrous filtration material, and optionally multiple segments comprised of a fibrous filtration material, typically a cellulosic filtration material, such as cellulose acetate tow.

At least one filter segment 4, 5, 6, may contain a particulate material, such as a sorbent or flavouring. The particulate material may be embedded in fibrous filtration material or contained in a cavity. The particulate material may be arranged between the rupture region of the directional capsule 7 and the first end of the filter element 13, or between the second end of the filter element and the directional capsule 7. Selection will depend on the desired effect on the characteristics of the mainstream smoke through the filter element 13.

The filter element 13 may comprise one or more filter wrappers surrounding or enclosing at least partly the filter components. For example, in multi-segment filters, one or more filter segments may be individually wrapped and some or all of the filter segments may be combined by a combiner filter wrapper.

Typically, the tipping wrapper 12 is generally rectangular and is wrapped cylindrically around at least part of the rod element of smokeable material 11 and at least part of the filter element 13. The tipping wrapper 12 is wrapped around and thereby encompasses or envelops at least part of the filter element 13 so that the tipping wrapper physically and mechanically attaches or connects the filter element 13 to the rod element of smokeable material 11. In this way, the tipping wrapper 12 will typically encompass or circumscribe the filter element 13 and an adjacent end portion of the rod element of smokeable material 11. Thus, the portion of the rod element of smokeable material encompassed or circumscribed by the tipping wrapper is typically in the range of 1 mm to 16 mm in length, for example in the range of 2 mm to 12 mm in length. As used herein, the term "length" denotes the dimension in the axial or longitudinal direction of the smoking article.

In a preferred embodiment, the tipping wrapper 12 includes a bonding region in which an adhesive is applied. That is, the tipping wrapper 12 is typically bonded in a region in which the tipping wrapper 12 overlaps with itself when wrapped around the filter element 13 and at least part of the rod element of smokeable material 11. The bonding region is preferably elongate and extends in a longitudinal direction of the smoking article 1; for example, along an edge portion of the tipping wrapper 12.

The rod element of smokeable material 11 may comprise any suitable tobacco cut filler. Preferably, the smoking article includes cigarette tobacco cut filler comprising types of tobacco such as Virginia, Burley, Oriental and Semi Oriental. The tobacco cut filler may comprise a blend of two or more different types of tobacco; e.g. of the above-mentioned types of tobacco. Alternatively, the tobacco cut filler may comprise a single one of the above-mentioned types of tobacco. The tobacco cut filler may comprise tobaccos that are, for example, air, sun or flue-cured. Alternatively or in addition, the tobacco cut filler may have undergone treatment, for example, to reduce tobacco-specific nitrosamines (TSNA). Besides tobacco leaf, the tobacco cut filler may include other ingredients typically found in tobacco cut filler such as, for example, expanded tobacco, homogenized tobacco (e.g. reconstituted tobacco, cast tobacco, or extruded tobacco), tobacco stem (e.g. expanded or improved stem), tobacco fines, and any combinations thereof. Flavours and casings comprising one or more humectants, flavourants, sugars or combinations thereof may also be applied to the tobacco cut filler in a known manner.

Figure 3:
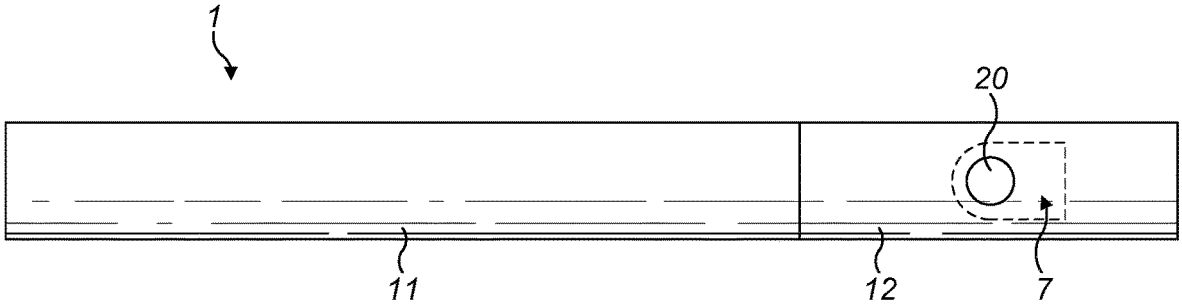
FIG. 3 is a side view of a smoking article in an embodiment of the present invention.

With reference to FIG. 3, the smoking article 1 comprises an indicator 20 provided in the tipping wrapper 12, or viewable through the tipping wrapper 12, for teaching a consumer how to best crush the directional capsule 7 (shown in phantom in FIG. 3, below the tipping wrapper 12). The size, shape and position of the indicator 20 are selected carefully to encourage a specific type of crushing that balances various competing interests. It is important, for example, to teach the consumer to provide a crushing force that will easily crush the capsule. It is also important that the consumer does not experience any discomfort or pain when crushing the directional capsule 7. In addition, it is important that the consumer is able to release a significant proportion of the volume of the liquid contained in the directional capsule 7 and that they can do so in a single crushing action.

The indicator 20 is sized, shaped and positioned to encourage the consumer to provide a crushing force at a desired position along the length of the filter 13. In particular, the indicator 20 can encourage the consumer to apply a force at a position that overlies a predefined crushing region in the directional capsule 7.

Figure 4:
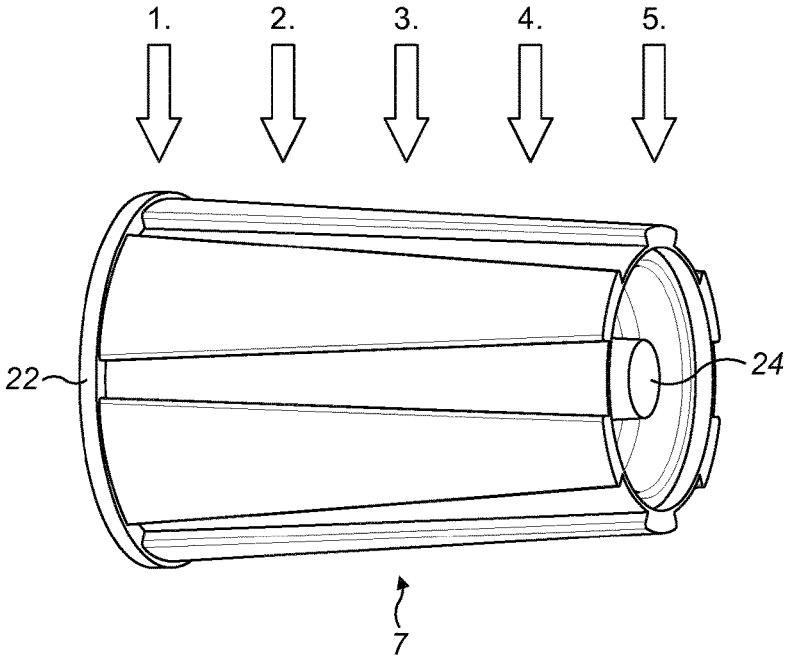
FIG. 4 is a perspective view of a liquid-filled directional capsule having a number of possible crush positions for use in an embodiment of the present invention.

FIG. 4 is a side view of a directional capsule 7 of the open-ended type having a base end or cap end 22 and a rupture end 24. The open end of the directional capsule's shell (i.e. the base end 22) ends in a rim to facilitate application of the cap, and has, therefore, a larger cross section than the rest of the shell. It has been found that when the consumer is able to view the entire directional capsule 7, but is not taught where to apply an external force to release its contents, the first attempt to break the directional capsule 7 is to apply the external force at the largest cross section of the directional capsule 7, which in this case corresponds to the cap end 22. However, this is not necessarily the best location where to apply force to attempt crushing the directional capsule 7, and, in this specific arrangement of the directional capsule 7, is actually the worse possible location, as will be explained below.

FIG. 4 depicts five possible positions where a crushing force could conceivably be applied. In this example the directional capsule has a length of 10 mm. Position 1 is at the cap end 22 of the directional capsule 7, which is 100% of the length of the directional capsule 7, when measured from the rupture end 24. This is the position where it has been found that the consumer would first attempt to crush the directional capsule 7. At position 1 it has been found that the directional capsule 7 is very difficult to crush, and that a consumer experiences discomfort in the attempt. Furthermore, the directional capsule 7 has occasionally ruptured at the cap end 22 instead of at the rupture end 24, causing liquid release in an undesired direction or into an undesired region. Position 2 is 2.5 mm from the cap end 22 in this embodiment, or 75% of the length of the directional capsule 7 when measured from the rupture end 24. At position 2 it has been found that the capsule remains difficult to crush, but the directional capsule 7 can nevertheless be crushed with the consumer experiencing some discomfort. The liquid release rate is close to 100% at position 2 and the consumer can recognise that crushing has occurred by feeling deformation of the directional capsule 7 with their fingers. Position 3 is 5 mm from the cap end 22 or 50% of the length of the directional capsule 7. At position 3 it has been found that the directional capsule 7 can be crushed with moderate ease and with minimal discomfort to the consumer. The liquid release from the capsule in position 3 has been determined to be approximately 80%. Position 4 is at 7.5 mm from the cap end 22, or 25% of the length of the capsule measured from the rupture end 24. At position 4 it has been found that the capsule can be crushed with moderate ease and without any discomfort to the consumer. The liquid release rate in this position has been determined to be approximately 70%. Position 5 is at the rupture end 24. The directional capsule 7 can be easily crushed at position 5 with no discomfort. However, the liquid release from the directional capsule 7 has been determined to be only around 50%. Different crushing positions may be preferred depending on the desired outcome. However, the presently preferred position, based on a balance of competing demands, is considered to be position 4 because it provides an adequate liquid release rate without the consumer experiencing any discomfort in the crushing action.

The indicator 20 can be printed on the tipping wrapper 12 using any of a number of media and/or techniques including inks, varnishes, lacquers, embossing, debossing, and hot foil stamping. In certain embodiments the indicator 20 is substantially circular, and the centre of the circle is arranged to overlie the preferred crushing region of the directional capsule 7. The circle may be circumferentially arranged on the smoking article such that the axis of symmetry of the circle is parallel to the main axis of the smoking article (for instance, the indicator 20 may be provided as a circumferential embossed ring in the tipping wrapper 12). In another embodiment the circle may be provided on the tipping wrapper 12 so that the axis of symmetry of the circle is perpendicular to the main axis of the smoking article. In other embodiments the indicator 20 is an arrow, the end of which overlies the preferred crushing region or ends adjacent to it.

Figure 5:
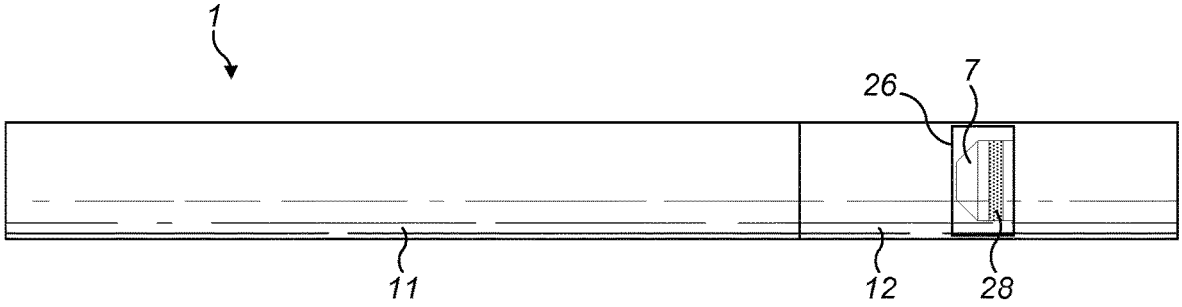
FIG. 5 is a side view of another smoking article in an embodiment of the present invention.

Of course, the indicator 20 may be provided at the tipping wrapper 12 using a variety of possible techniques. In one arrangement, with reference to FIG. 5, the indicator 20 may comprise a transparent window 26 in the tipping wrapper 12 which both teaches the consumer about the presence of the directional capsule 7 and also encourages the consumer to provide a crushing force in the location of the window 26. This may be achieved by providing the window 26 in a particular shape, such as a circle or an arrow. In a further arrangement the indicator 20 may include a marking 28 on an outer surface of the directional capsule 7, which is viewable through the window 26. The marking 28 on the directional capsule 7 may teach the consumer about where to apply their crushing force to achieve optimal results. The marking 28 can be made using any of a number of media and/or techniques including inks, varnishes, lacquers, embossing, debossing, and hot foil stamping. In embodiments where an outer surface of the directional capsule 7 has a marking 28 and the filter element 13 includes a filter wrapper that overlies the marking 28, the filter wrapper may be transparent or contain a transparent window similar to transparent window 26 so that the marking 28 is viewable through the filter wrapper and the tipping wrapper 12.

Figure 6A:
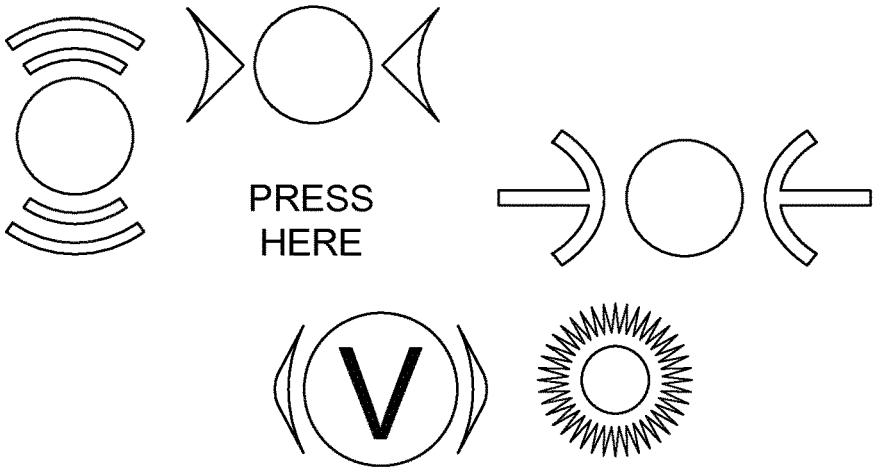
FIGS. 6*a*, and 6*b* are possible examples of indicators according to the present invention.
Figure 6B:
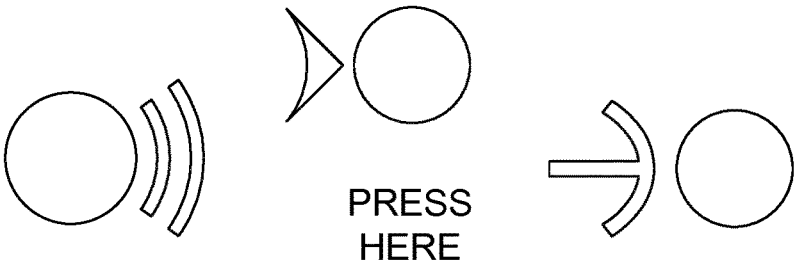

FIGS. 6*a*, and 6*b* show a number of possible forms for the indicator 20 that can be printed on the tipping wrapper 12, the filter wrapper, or marked on the directional capsule 7. The forms indicated in FIG. 6*b* correspond to examples of directional indicators. Text, such as "PRESS HERE", may be provided in addition to or in substitution of other forms for the indicator 20. The examples in FIGS. 6*a* and 6*b* show indicators 20 that can be printed in order to provide an optical contrast with the region around them. A printed indicator 20 may be slightly embossed or debossed relative to its surroundings. Thus, the printed indicator 20 may provide a visual and tactile contrast with its surrounding region. A tactile sensory contrast may also be provided by an indicator 20 having differences in surface tension or differences in surface roughness in comparison with the surrounding region. The indicator 20 may be provided as a sticker that is glued to a surface of the tipping wrapper 12. In another arrangement the indicator 20 can provide a taste contrast by providing a flavour that differs from the flavour of the surrounding region; such an arrangement may be useful for consumers who choose to break the directional capsule 7 with their teeth. In a preferred arrangement a flavouring indicator can be provided in a circumferential ring on the tipping wrapper 12. Any combination of sensory contrasts can be provided according to consumer preferences.

In some embodiments the indicator 20 may be user activated. Thus, the indicator 20 may be initially invisible, but an optical contrast may become apparent after it has been touched or wetted. The indicator 20 may comprises a chromic material to enable a colour change when the indicator is exposed to an external stimulus, such as light, heat, solvent polarity, pH change, mechanical friction, or mechanical pressure.

Figure 7:
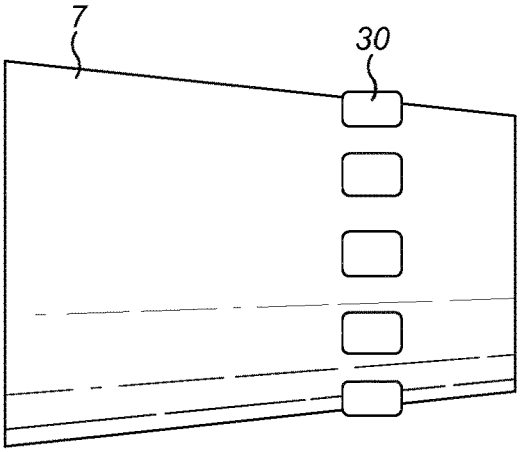
FIG. 7 is a perspective view of a liquid-filled directional capsule having a projection that can serve as an indicator for use in an embodiment of the present invention.

FIG. 7 shows a directional capsule 7 having a plurality of projections 30. The projections 30 are positioned 7.5 mm from the cap end 22, or 25% of the length of the directional capsule 7 measured from the rupture end 24 (corresponding to position 4 in FIG. 4). The projections 30 are arranged at a desired crushing region of the directional capsule 7. In use, the projections 30 can serve as an indicator which is identifiable through the tipping wrapper 12 by touch. The projections 30 in FIG. 7 are shown at spaced positions on the circumference of the directional capsule 7. In another embodiment a circumferential projection 30 may be provided around the directional capsule 7 such that it can be identified by touch at positions around the circumference of the tipping wrapper 12. A plurality of projections 30 are shown but one or more projections 30 may be effective in other embodiments. As an alternative the projections 30 may be provided as an embossed section on a filter wrapper which can be identified by touch through the tipping wrapper 12. The projections 30 may be provided at a position that underlies a visual indicator 20 on the tipping wrapper 12 so that there is a combined visual and tactile indication for a consumer. In other embodiments the projections 30 may be provided without any corresponding visual indicator in the tipping wrapper 12.

In the embodiments above the invention has been described in the context of a single directional capsule. Of course, in other embodiments the filter element may comprise more than one capsule, for example one or more directional capsules and one or more non-directional capsules. Where one or more directional capsules are provided, all of the directional capsules may be oriented in the same direction; alternatively, one or more directional capsules may be oriented in a first direction (with their respective rupture region pointing towards the end for connection to the rod element 11 of smokeable material, i.e. the first end 2 of the filter element 13) and one or more capsules may be oriented in a second direction (with their respective rupture region pointing towards the end for insertion into the mouth of the user, i.e. the second end 3 of the filter element 13).

The invention claimed is:

1. A smoking article, comprising:

a rod element of smokeable material connected to a filter element by a tipping wrapper, the filter element having a first end for connection to the rod element and an opposite, second end for insertion into a mouth of a user, the filter element comprising:

an elongate liquid-filled directional capsule adapted to direct liquid release into a particular desired direction or towards a particular desired region along an axial direction of the filter element, said elongate liquid-filled directional capsule having a longitudinal axis and being arranged between the first and second ends of the filter element such that the longitudinal axis of the elongate liquid-filled directional capsule extends substantially parallel to the axial direction of the filter element, the directional capsule having a predefined rupture region only oriented toward the rod element at which the directional capsule is designed to break upon application of external force to release the liquid contained therein, wherein the directional capsule comprises a predefined crushing region, wherein the predefined crushing region is located between the rupture region of the directional capsule and 35% of a length of the directional capsule measured from a rupture end of the directional capsule, the location of the predefined crushing region structurally allowing for release of at least 70% of the liquid in the capsule upon the application of external force; and an indicator provided at the tipping wrapper, or identifiable through the tipping wrapper, for indicating a predefined force application region, the predefined force application region overlying the predefined crushing region.

2. The smoking article according to claim 1, wherein the predefined crushing region is located between 15% of the length of the directional capsule measured from the rupture end of the directional capsule and 35% of the length of the directional capsule measured from the rupture end of the directional capsule.

3. The smoking article according to claim 1, wherein the indicator includes a directional element.

4. The smoking article according to claim 1, wherein the indicator has a centroid that overlies the predefined crushing region of the directional capsule.

5. The smoking article according to claim 1, wherein the indicator is arranged to provide a sensory contrast with a region around the indicator.

6. The smoking article according to claim 1, wherein the filter element comprises a filter wrapper, and the indicator is provided at the filter wrapper.

7. The smoking article according to claim 1, wherein the indicator is viewable through a region in the tipping wrapper.

8. The smoking article according to claim 7, wherein the indicator comprises a marking on the directional capsule.

9. The smoking article according to claim 1, wherein the directional capsule contains a liquid volume of at least 0.05 ml.

* * * * *